United States Patent [19]

Hosoda et al.

[11] Patent Number: 4,794,037

[45] Date of Patent: Dec. 27, 1988

[54] FLAME-PROOF FIBER PRODUCT

[75] Inventors: Yoshinori Hosoda, Otsu; Shunroku Tohyama, Shiga; Heiroku Suganuma, Otsu, all of Japan

[73] Assignee: Toray Industries Incorporated, Japan

[21] Appl. No.: 14,119

[22] Filed: Feb. 2, 1987

Related U.S. Application Data

[63] Continuation of Ser. No. 712,262, Mar. 15, 1985, abandoned.

[30] Foreign Application Priority Data

Mar. 16, 1984 [JP] Japan ..... 59-49278

[51] Int. Cl.[4] ..... B32B 9/00; D02G 3/00

[52] U.S. Cl. ..... 428/264; 8/115.5; 8/115.6; 428/224; 428/265; 428/272; 428/276; 428/277; 428/288; 428/289; 428/361; 428/394; 428/395; 428/921; 428/372

[58] Field of Search ..... 428/264, 265, 288, 290, 428/276, 277, 272, 273, 372, 375, 394, 395, 361, 921, 224, 289; 8/115.5, 115.6, 115.7, 116.1

[56] References Cited

U.S. PATENT DOCUMENTS

| | | | |
|---|---|---|---|
| 3,870,590 | 3/1975 | Hurwitz | 428/921 X |
| 3,873,504 | 3/1975 | Boettcher et al. | 428/921 X |
| 3,884,628 | 5/1975 | Duffy et al. | 8/115.7 |
| 4,035,542 | 7/1977 | Rosenthal et al. | 428/224 |
| 4,136,037 | 1/1977 | LeBlanc et al. | 428/921 X |
| 4,154,890 | 5/1979 | Wagner | 428/921 X |
| 4,156,747 | 5/1979 | Wagner | 428/921 X |
| 4,187,377 | 2/1980 | Narisawa et al. | 428/921 X |
| 4,196,260 | 4/1980 | Nachbur | 427/921 X |
| 4,295,886 | 10/1981 | Gresham | 428/921 X |

*Primary Examiner*—Lorraine T. Kendell

*Attorney, Agent, or Firm*—Scully, Scott, Murphy & Presser

[57] ABSTRACT

A fabric containing a cellulosic fiber and a polyester fiber having a carbonization burning mechanism, superior in flame-proofness and having a soft touch. The fabric contains a halogen- and/or phosphorus-based flame-proofing agent, and preferably also contains an amino resin.

14 Claims, No Drawings

FLAME-PROOF FIBER PRODUCT

This application is a continuation of application Ser. No. 712,262, filed Mar. 15, 1985 abandoned.

BACKGROUND OF THE INVENTION

The present invention relates to a fiber product comprising cellulosic fiber and polyester fiber and having both a superior flame-proofness and a good touch (hand).

Heretofore, efforts have been made for overcoming the disadvantage common to both synthetic and natural fibers that the fibers are easy to burn. And various proposals have been made for this purpose. With these proposed methods, it is now possible to modify various synthetic fibers, including polyester and nylon, as well as natural fibers to the extent of conforming to domestic and foreign flammability safety standards, using flame-proofing agents specified according to the kind of fibers.

Fiber products containing both natural and synthetic fibers exhibit superior performances as a synergistic effect of the characteristics of both fibers, and because of this advantage they have recently been applied to various uses. Particularly, polyester fiber-cellulosic fiber products, such as woven-, knitted- or nonwoven-fabrics whose main constituent fibers are polyester type fibers and cellulosic fibers, are in wide use as clothing, bed cloth and sheet and interior materials, and a strong demand exists for their flame-proofing. With the conventional flame-proofing techniques, however, it has been impossible to render such fiber products flame-proof to a practical extent in their use as clothing.

It has heretofore been considered very difficult to make flame-proof polyester fiber-cellulosic fiber products. This is closely related to the marked difference in burning mechanism of the two. More particularly, the burning mechanism of cellulosic fibers is carbonization mechanism, while that of polyester fibers is drip mechanism. Consequently, when the fiber product burns, the dropout of flammable substance from the burning system by melting of polyester fiber is prevented due to the presence of carbonized residue of cellulosic fiber, so that the fiber product as a whole becomes easier to burn. This phenomenon, called Scaffolding Effect, is well known. It is therefore evident that even if the polyester fiber and the cellulosic fiber are each independently rendered flame-proof, it is impossible to prevent the above effect. Thus, how to make such fiber product flame-proof has been the most difficult problem.

Attempts have heretofore been made to solve this problem by bonding a large amount of a flame-proofing agent to the fiber product (see Japanese Patent Publication (JPB) Nos. 32000/77 and 31999/78 corresponding to U.S. Pat. Nos. 3,822,327 and 3,907,898). According to such techniques, the flame-proofness may be attained to some extent, but the resulting fabrics are very hard and poor in color fastness, not applicable at all to such uses as clothing and bed cloth and sheet.

Also known is an attempt to achieve the flame-proofing of the fiber product by combining a flame-proofing agent with a triazine derivative coating (see Japanese Patent Laid Open (JPA) No. 126368/83). According to this method, it is possible to attain flame-proofness to a somewhat higher extent corresponding to the presence of such coating, but also in this method a large amount of flame-proofing agent must be bonded to the fiber product to conform to the U.S. DOC FF-3-71 (flame-proofing regulations on children's night clothes) and Article 8-3 (flame-proofing regulations on curtain) of the Shobo-Act (Japanese Fire Proof Act). Consequently, even if a practical level of flame-proofness is attained, a marked deterioration results in point of touch (hand) and color fastness.

As to flame-proofing polyester fiber, Japanese Patent Laid Open Nos. 43221/75 and 43222/75 disclose a method of producing a flame-proof fiber by treating polyester fiber containing a large amount of antimony oxide with a phosphorus compound. It can be seen that the flame-proofing of polyester fiber is attained by this method. However, this method makes only polyester fiber flame-proof and thus is a mere extension of the conventional flame-proofing method for synthetic fibers.

In connection with flame-proofing a fiber product comprising polyester fiber and cellulosic fiber, it is a well-known fact that with a mere application of well-known phosphorus- or halogen-based flame-proofing agents to the fiber product surface, the fiber product does not exhibit flame-proofness. The burning mechanism of such fiber product has been made clear by the analysis of thermal degradation. More particularly, cellulosic fiber begins to undergo a thermal degradation on a lower temperature side than polyester fiber, and a flame-proofing component imparted to the polyester fiber is thereby deprived of in an early stage of thermal degradation of the cellulosic fiber, resulting in that the amount of the flame-proofing component acting on polyester becomes very small and the Scaffold Effect by the cellulosic fiber acts to accelerate the burning of polyester.

Under the above-mentioned facts, it has been a commonly accepted idea of those skilled in the art that even such a flame-proofing agent as is effective for polyester fiber alone does not effective for a blended product thereof with other fibers.

SUMMARY OF THE INVENTION

It is an object of the present invention to provide a flame-proofing technique capable of imparting a high level of flame-proofness to a fiber product comprising cellulosic fiber and polyester fiber without deterioration of touch (hand) and color fastness.

It is another object of the present invention to provide a blended fiber product which exhibits a superior carbonization (or char-formation) accelerating effect.

The present invention resides in a flame-proof fiber product comprising a cellulosic fiber and a polyester fiber having a carbonization burning mechanism, the fiber product containing a halogen-and/or phosphorus-based flame-proofing agent.

DESCRIPTION OF THE PREFERRED EMBODIMENTS

Examples of the cellulosic fiber used in the present invention are such natural fibers as cotton and hemp as well as such cellulose-based fibers as viscose rayon, cellulose acetate and cuprammonium rayon.

The polyester fiber having a carbonization burning mechanism referred to herein indicates a polyester fiber which becomes carbonized when burnt, that is, burns in about the same manner as cellulose. It has now become clear that polyester fibers can afford an effective flame-proofness when used together with cellulosic fibers.

Polyesters containing large amounts of antimony oxides are mentioned as examples of polyester fibers having such carbonization burning mechanism in the present invention.

The polyester fiber referred to herein indicates a fiber comprising a known polyester type polymer. Examples of such polymer are mainly aromatic polyesters such as polyethylene terephthalate and polybutylene terephthalate. Other polyesters are also employable such as, for example, polyesters whose acid moieties have been partially replaced by other bifunctional carboxylic acids, e.g. isophthalic acid, hydroxyethoxybenzoic acid, diphenyl ether dicarboxylic acid, adipic acid and 5-sodium sulfoisophthalic acid; as well as polyesters whose glycol moieties have partially or wholly been replaced by other dihydroxy compounds, and polyesters comprising combinations thereof.

Examples of the antimony oxide referred to herein include antimony trioxide, antimony tetroxide, antimony pentoxide, and mixtures thereof. Especially, antimony trioxide is superior and preferable in view of its synergistic effect with a flame-proofing agent, namely acceleration of the carbonization burning, as will be described later. The smaller the particle size of the antimony oxide, the better. Its fine particles not larger than 50 $\mu$, preferably not larger than 10 $\mu$, are used.

In the case where the carbonization burning mechanism of the polyester fiber is to be attained by the addition of antimony oxide, the antimony oxide is incorporated in the polyester in an amount of at least 1%, preferably 3–30%, more preferably 5–20%, most preferably 10–15%, by weight.

The antimony oxide may be incorporated in the polyester either before or after fiber forming step such as melt-spinning. In view of its reaction with the polyester and the flame-proofing agent during burning, it is preferable that the antimony oxide be present as it is in the polyester. Further, in view of its dispersibility in the polymer it is desirable that the antimony oxide be incorporated in the polyester in any of fiber forming and preceding steps. Particularly, for suppressing the reduction of this compound, it is more desirable to effect its addition after polymerization rather than before polymerization. The antimony oxide incorporating method is not specially limited. For example, in the case of a polyester containing a large amount of antimony oxide, a composite yarn comprising such polyester as a core and a polyester as a sheath containing a white pigment or a delustering agent and not substantially containing antimony oxide is preferable in point of processability such as spinning, dyeing and finishing properties and physical properties.

The fiber product referred to herein indicates a blended fiber product containing at least cellulosic fiber and polyester fiber, including mainly woven-, knitted- and nonwoven-fabrics formed via such means as filament mixing, blended fiber spinning, twisting using different yarns or knitting and weaving using different yarns. Wadding like blends of both fibers are also included.

The ratio of the cellulosic fiber to the polyester fiber having the carbonization burning mechanism is in the range of about 5/95 to 95/5, preferably about 20/80 to 80/20, in terms of weight ratio. The ratios outside this range are unsuitable.

The halogen-based flame-proofing agent referred to herein indicates a conventional flame-proofing compound containing a halogen atom as an effective component. Above all, those containing at least one chlorine or bromine atom are preferred. Particularly, bromine-containing compounds are superior in synergistic effect with antimony oxide. Bromine reacts with antimony into antimony bromide during reaction, which exhibits an extremely superior flame-proofing effect.

For incorporating such compounds in the fiber product so as to afford a good durability without causing the problem of coarse touch, it is desirable to make a further selection. Preferred compounds for this purpose are those which are easily absorbed in the fiber interior and those which easily adhere to the fiber surface uniformly. Examples of such compounds are as follows:

(1) Cycloalkanes containing 7 to 12 carbon atoms and 3 to 6 halogen atoms bonded to carbon, e.g. hexabromocyclododecane (2) Phenylglycidyl derivatives containing 1 to 6 halogen atoms bonded to benzene ring, e.g.

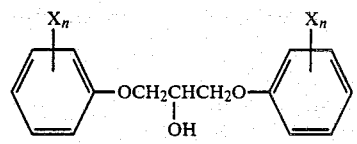

wherein X is chlorine or bromine atom and n in an integer of 1 to 3.

(3) Halogen compounds represented by the following general formula:

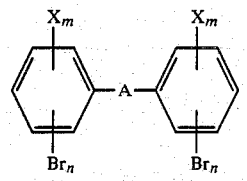

wherein X is —R, —OR, —OH or $$-O(\overset{R'}{\overset{|}{C}}H\overset{R''}{\overset{|}{C}}HO)_zH$$

where R is an alkyl or halogenated alkyl having 1 to 3 carbon atoms, R′ and R″ are each H or $CH_3$ provided R′ and R″ are not $CH_3$ simultaneously, and z in an integer of 1 to 4; A is not present or a radical selected from —O—, —NH—, $-CH_2-$, $$-\overset{CH_3}{\overset{|}{\underset{CH_3}{\underset{|}{C}}}}- \quad \text{and} \quad -SO_2-;$$

m is an integer of 0 or 1 to 4; and n is an integer of 1 to 5.

(4)

$$\begin{matrix} Z_1-O \\ Z_2-O-P=O \\ Z_3-O \end{matrix}$$

wherein $Z_1$, $Z_2$ and $Z_3$ are each a radical selected from halogenated aliphatic radicals and aromatic radicals.

The higher the halogen content, the more enhanced the flame-proofing effect of the compounds exemplified above. These compounds may be used alone or in combination. Particularly, halogenated cycloalkanes are effective in the present invention.

The phosphorus-based flame-proofing agent referred to herein indicates a flame-proofing compound containing at least one phosphorus atom. In such phosphorus compounds, the quantity of phosphorus atom rather than the structure effects the flame-proofing effect, so even phosphoric acid and other inorganic phosphorus compounds such as ammonium phosphate, ammonium polyphosphate and guanidine phosphate are effective. However, flame-proofing phosphorus compounds containing vinyl or epoxy group are preferred in order to impart a good washing durability to the fiber product. The following are examples of vinyl or epoxy group containing compounds:

Vinyl group-containing flame-proofing phosphorus compounds:

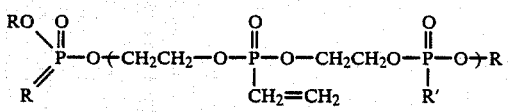

R: $C_1$–$C_{10}$ alkyl or $C_1$–$C_{10}$ haloalkyl
R': $-OCH_2CH_2X$ or alkyl or haloalkyl
X: halogen (chlorine or bromine)

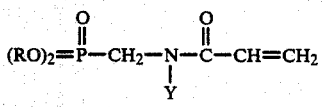

R: phenyl or lower alkyl
Y: hydrogen or lower alkyl

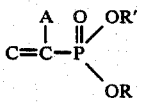

wherein R and R', which may be the same or different or conjointly form a single radical, are each a hydrocarbyl or substituted hydrocarbyl radical consisting principally of hydrogen and carbon and having not more than 18 carbon atoms.

A: hydrogen or $CH_2$

Epoxy group-containing flame-proofing phosphorus compounds:

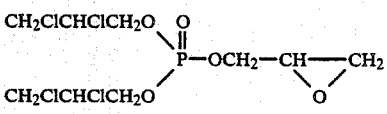

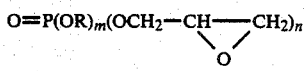

$(m + n = 3, m \neq 0, n \neq 0)$

R: $C_2$ or less alkyl, $C_2$–$C_3$ halogenated alkyl or halogenated aryl

In the above compounds, the higher the phosphorus content, the more enhanced the flame-proofing effect. These phosphorus compounds may be used alone or in combination. Further, from the standpoint of flame-proofness it is desirable that these phosphorus compounds be present in a chemically reacted state with later-described amino resins. Moreover, these phosphorus compounds may be mixed with an emulsifier, a catalyst, a crosslinking agent, a size, etc.

Combination of both the halogen compound and the phosphorus compound is more effective for enhancing the flame-proofness of the fiber product than either compound alone, because the absorbability by polyester or cellulose is different between the halogen compound and the phosphorus compound. More particularly, the halogen compound is well absorbed by polyester, but the absorbability of the phosphorus compound by polyester is not so high. On the other hand, the phosphorus compound is locally present in and around the cellulose fiber, but the halogen compound is little absorbed by the cellulose fiber. Thus, it is seen that in order to let the flame-proofing agent act effectively on both fibers, a combined use of both phosphorus and halogen compounds is effective.

The content of the flame-proofing agent is determined according to the antimony oxide content, the cellulosic fiber proportion as well as the weave and form of fabric, particularly on the basis of the amounts of antimony oxide and fibers.

More specifically, the flame-proofing agent is used in an amount ½ to 5 times, preferably 1 to 3 times, the content of antimony oxide, and its content is in the range of 5 to 30 wt.%, preferably 10 to 20 wt.%, of the fiber weight. Although the flame-proofing agent may be used in an amount exceeding this range, the surplus portion is merely discharged at the time of washing and causes a coarse touch; besides, the flame-proofness reaches saturation and does not improve any more, and thus disadvantages result.

Preferably, the flame-proofing agent is applied to the fiber product by absorption treatment using a high temperature solution or dispersion thereof, such as impregnation, followed by heated steaming treatment (or dry heat treatment, electron or plasma irradiation), or coating.

Particularly preferably, the flame-proof fiber product of the present invention has an amino resin of the fiber surfaces, and such an amino resin-coated fiber product exhibits superior performances. The amino resin referred to herein indicates a monomeric compound which is crosslinkable and polymerizes into a highly heat-resistant resin and which cooperates with the flame-proofing agent to accelerate the carbonization (or char forming) of the cellulose and the polyester having a carbonization burning mechanism. Examples are triazine compounds such as melamine, formoguanamine and benzoguanamine, as well as cyclic urea compounds such as ethylene urea, uron and hydroxyethylene urea. Above all, triazine compounds, especially melamine, are preferred.

Preferred examples of melamine are those represented by the following general formula:

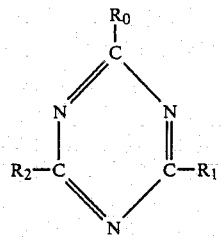

wherein $R_0$—$R_2$:—H, —OH, —$C_6H_5$, —$C_nH_{2n+1}$, (n:1-10), —$COOC_mH_{2m+1}$, —$CONR_3R_4$, —$NR_3R_4$($R_3$, $R_4$:—H, —OH), —$OC_mH_{2m+1}$, —$CH_2OC_mH_{2m+1}$, —$CH_2COOC_mH_{2m+1}$(m:1-20), —$CH_2OH$, —$CH_2CH_2OH$, —$CONH_2$, —$CONHCH_2OH$, —$O(X—O)_{n1}R_5$ (X:$C_2H_4$, $C_3H_6$, $C_4H_8$, $R_5$:—H, —$CH_3$, —$C_2H_5$, —$C_3H_7$, n1:1-1500).

Among the compounds of the above general formula, those wherein $R_0$ and $R_1$ are each —$NR_3R_4$ are more preferable, and those wherein $R_2$ is —$CONR_3R_4$ or, —$NR_3R_4$ are still more preferable, of which those wherein $R_3$ and $R_4$ are each —$CH_2OH$, —$CH_2CH_2OH$, —$CONH_2$ or —$CONHCH_2OH$ are particularly preferred.

Compounds wherein $R_0$, $R_1$ and $R_2$ are each —$NR_3R_4$ and $R_3$ and $R_4$ are each —H, —$OC_nH_{2n+1}$, —$CH_2OC_nH_{2n+1}$, (n:1-16), —$CH_2OH$, —$CH_2CH_2OH$, —$CONH_2$ or —$CONHCH_2OH$ are capable of forming a coating even when allowed to stand in wet condition.

The content of the amino resin is in the range of 0.5 to 15%, preferably 1 to 10%, more preferably 2 to 7%, based on the fiber weight. In the case where it is used as a mixture with the flame-proofing agent, its too small proportion would make it difficult to attain the carbonization accelerating effect or the coating forming effect, and its too large proportion would deteriorate the flame-proofing effect.

To ensure the formation of such amino resin coating, the amino compound my be used alone. But, in the present invention, even if it is mixed with the flame-proofing agent either before or after the coating formation, the carbonization accelerating effect will be attained to about an equal extent. The effect of distributing the flame-proofing agent uniformly throughout the fibers is attained by a mixed system of the amino compound and the flame-proofing agent. According to this method, the flame-proofing agent can be distributed uniformly in a very small amount, and it is also possible to support it on the fiber surfaces at a high concentration.

The amino resin is obtained by heat-treating the amino compound and a polymerization catalyst in the presence of water.

Examples of the catalyst include inorganic and organic acids and salts thereof. The catalyst is used usually in an amount of 0.01 to 5 wt.% based on the weight of the amino compound.

The heat treatment is performed by heated steaming at a relative humidity not lower than 40%. As to the treatment temperature, the polymerization can be carried out even at room temperature in the case of some particular amino compounds. At low temperatures (incl. room temperature), the polymerization can be attained in a treating time of 15 to 30 hours, and at temperatures not lower than 40° C., preferably in the range of 80° to 135° C., the resinifying can take place in a treating time of about 0.5 to 180 minutes.

In the case where the amino compound is used alone, a treating solution containing 0.1 to 50 wt.% based on the fiber weight of the amino compound is prepared and impregnated into the fiber product by padding or immersion, followed by the above heat treatment.

The thus-obtained cellulosic fiber-polyester fiber blended product has a superior flame-proofness conforming to the standards defined in Article 8-3 of the Shobo Act (Japanese Fire Proof Act) and the U.S. DOC FF-3-71 and also has a soft touch and a superior color fastness.

In the flame-proof fiber product obtained using the halogen- and phosphorus-based flame-proofing agent and the amino resin, the amino resin is present as a coated layer on the surface of the constituent fibers, and halogen such as bromine is dispersed in the polyester, while phosphorus is present mainly in the amino resin and cellulose, not much in the polyester. The flame-proof fiber product of the invention having such a structure is useful as the material of curtain, car seat, bed cloth and sheet, and wall surfacing.

The following examples are given to further illustrate the present invention concretely in detail, but it is to be understood that the invention is not limited thereto.

EXAMPLE 1

Polyester fiber (75D-20F) containing 10 wt.% of antimony trioxide and cotton yarn (140S two-folded yarn) were co-twisted and it was knitted to obtain a cylindrical knitted fabric having a weight of 180 g/m$^2$. This fabric was rendered flame-proof using two kinds of halogen compounds-hexabromocyclododecane (hereinafter referred to as HBCD) and 4,4'-hydroxyethyl-2,2',5,5'-tetrabromobisphenol A (hereinafter referred to as TBAEO). The flame-proofing was performed by impregnating the fabric with an aqueous dispersion of each of those halogen compounds, then squeezing the impregnated fabric with rubber rolls, followed by drying and heat treatment at 180° C. for 2 minutes. Then, the fabric was washed with water at 60° C. for 10 minutes and then dried. The amount of each compound bonded to the fabric was calculated on the basis of a change in weight before and after the processing. The thus-processed fabric was evaluated for flame-proofness in accordance with the U.S. DOC FF-3-71 (Vertical Flaming Test, 3 seconds contact with flame).

By way of comparison, fabrics were made and processed in the same way as in Example 1 except that a conventional polyester fiber containing only 0.03 wt.% of antimony trioxide was used.

Results are as set out in Table 1, from which it is seen that the fabrics comprising the antimony trioxide-containing polyester and cotton and having been rendered flame-proof with the above halogen compounds exhibit a high flame-proofness, while those obtained using polyester containing only a very small amount of antimony trioxide is easily flammable despite of the same amount of the halogen compounds bonded thereto, and that with only the antimony trioxide-containing polyester, the flame-proofness cannot be attained.

TABLE 1

| | | $Sb_2O_3$ Content (wt. %) | Pickup (wt. %) | Flame-proofness Carbonized Length (cm) (cm) | Flame-proofness After Flame Time (sec) | DOC-FF-3-71 Acceptable or Not | Br Content (wt. %) |
|---|---|---|---|---|---|---|---|
| Comparative Example | | | | | | | |
| 1-1 | HBCD | 10 | 3.4 | burnt down | — | X | 2.54 |
| Example | | | | | | | |
| 1-1 | " | " | 6.3 | 16.5 | 8 | ○ | 4.71 |
| 1-2 | " | " | 8.1 | 13.2 | 2 | ○ | 6.05 |
| 1-3 | " | " | 11.4 | 11.6 | 0 | ○ | 8.52 |
| 1-4 | " | " | 13.9 | 10.8 | 0 | ○ | 10.38 |
| Comparative Example | | | | | | | |
| 1-2 | TBAEO | " | 3.2 | burnt down | — | X | 1.62 |
| Example | | | | | | | |
| 1-5 | " | " | 6.8 | 17.1 | 9 | ○ | 3.44 |
| 1-6 | " | " | 7.9 | 13.4 | 5 | ○ | 4.00 |
| 1-7 | " | " | 12.1 | 11.3 | 0 | ○ | 6.12 |
| Comparative Example | | | | | | | |
| 1-8 | HBCD | 0.03 | 8.0 | burnt down | — | X | 6.98 |
| 1-9 | " | " | 16.1 | " | — | X | 12.03 |
| 1-10 | TBAEO | " | 8.3 | " | — | X | 4.20 |
| 1-11 | " | " | 18.7 | " | — | X | 13.97 |
| 1-12 | Unprocessed | 10 | — | burnt down | — | X | |

In the above table:
$Sb_2O_3$ Content: weight percent (based on the polyester fiber)
Pickup: Pickup of halogen compound in weight percent (based on the fiber product)
Flame-proofness:
Carbonized Length: cm
After Flame Time: second
Unprocessed: not treated with flame-proofing compound
○: acceptable
X: not acceptable

EXAMPLE 2

Blended 50/50 fabrics (plane woven fabrics) comprising polyester fibers of different antimony trioxide contents and cotton yarn and each having a weight of 210 g/m$^2$ were produced and then processed using an aqueous HBCD dispersion in the sameway as in Example 1. A study was made about the pickup of HBCD in the cases of 5–9 wt.% and 20–25 wt.%. Results are as set out in Table 2.

TABLE 2

| | $Sb_2O_3$ Content (wt. %) | Pickup (wt. %) | Flame-proofness Carbonized Length (cm) | Flame-proofness After Flame Time (sec) | Br Content (wt. %) |
|---|---|---|---|---|---|
| Comparative Example | | | | | |
| 2-1 | 0.5 | 11.3 | burnt down | — | 8.44 |
| 2-2 | " | 24.5 | burnt down | — | 18.30 |
| Example | | | | | |
| 2-1 | 2.0 | 10.8 | 21.3 | 8 | 8.07 |
| 2-2 | " | 25.2 | 15.4 | 4 | 18.82 |
| 2-3 | 5.0 | 5.8 | 18.3 | 17 | 4.33 |
| 2-4 | " | 11.3 | 13.7 | 2 | 8.44 |
| 2-5 | " | 24.2 | 8.2 | 0 | 18.08 |
| 2-6 | 10.0 | 6.1 | 16.4 | 8 | 4.56 |
| 2-7 | " | 10.5 | 11.3 | 0 | 8.44 |
| 2-8 | " | 23.6 | 7.6 | 0 | 17.63 |
| 2-9 | 20.0 | 6.8 | 11.7 | 0 | 5.08 |
| 2-10 | " | 11.7 | 8.1 | 0 | 8.74 |
| 2-11 | " | 20.8 | 6.8 | 0 | 15.54 |

As shown in Table 2, at the amount of 0.5 wt.% of antimony oxide contained in polyester, the polyester melted, not exhibiting the carbonization burning mechanism, and the Scaffolding Effect was recognized, but at its amount of 2 wt.% there was recognized a carbonization burning tendency. Particularly, at its contents not less than 5 wt.% the polyester was burnt and carbonized completely like cellulose and thus proved to improve in its flame-proofness to a remarkable extent.

EXAMPLE 3

A blended 50/50 fabric (plane woven fabric) comprising polyester fiber containing 10 wt.% of antimony trioxide and cotton yarn and having a weight of 260 g/m$^2$ was produced. The fabric was impregnated with each of the following treating compositions and subjected to heated steaming at 103° C. for 5 minutes, followed by washing with water and drying:

| Treating Compositions | A | B | C |
|---|---|---|---|
| Hoskon-76 (vinyl phosphonate, a product of Meisei Kagaku K. K.) | 15 | 15 | 30 |
| N—methylolacrylamide (solids content: 60%) | 3.25 | 7.5 | 15 |
| Potassium persulfate | 0.5 | 0.5 | 0.5 |
| Water | 81.25 | 77 | 69.5 |

The flame-proofness of the thus-processed fabric was determined and evaluated in terms of carbonized length and after flame time in the same manner as in Example 1.

As Comparative Examples 3-1 to 3-3, fabrics were obtained and flame-proofed in the same way as in Example 3 except that there was used conventional polyester fiber, and as Comparative Examples 3-4 to 3-6, flame-proof fabrics were obtained by dry heat curing at 160° C. for 3 minutes in accordance with the method of Example 2 disclosed in the specification of U.S. Pat. No. 3,822,327.

Results are as set out in Table 3, from which it is seen that the flame-proof fabrics of the present invention exhibit an extremely high flame-proofness and little change of touch, while the comparative fabrics are markedly inferior in flame-proofness in the region of less change of touch.

TABLE 3

| | $Sb_2O_3$ Content of Polyester Fiber (wt. %) | Treating Bath | Pickup (wt. %) | Flame-proofness Carbonized Length (cm) | Flame-proofness After Flame Time (second) | Touch (mm) | P Content (wt. %) |
|---|---|---|---|---|---|---|---|
| Example | | | | | | | |
| 3-1 | 10 | A | 9.4 | 23.4 | 7 | 62 | 1.2 |
| 3-2 | " | B | 15.1 | 13.6 | 3 | 68 | 2.0 |
| 3-3 | " | C | 29.7 | 11.9 | 0 | 73 | 3.9 |
| Comparative | | | | | | | |
| 3-1 | 0.03 | A | 7.2 | burnt down | — | 59 | 0.9 |
| 3-2 | " | B | 15.6 | " | — | 69 | 2.0 |
| 3-3 | " | C | 30.4 | " | — | 81 | 4.0 |
| 3-4 | " | A | 12.1 | " | — | 73 | 1.6 |
| 3-5 | " | B | 17.3 | " | — | 94 | 2.2 |
| 3-6 | " | C | 34.5 | 22.8 | 13 | 131 | 4.5 |

(Note)
Touch: Evaluated in terms of the toughness defined by JIS L-1079. The larger the numerical value, the harder.

EXAMPLE 4

Blended 50/50 fabrics (plane woven fabrics) comprising polyester fibers having different antimony trioxide contents and cotton yarn and having a weight of 260 g/m² were impregnated with the following treating compositions in the same way as in Example 3.

| Treating Compositions | A | B |
|---|---|---|
| Pyrovatex CP (dialkylphosphonopropionic amide, a product of CIBA-geigy AG) | 20 | 40 |
| Sumitex Tesinn M-3 (melamine compound, a product of Sumitomo Chemical Co., Ltd.) | 3 | 6 |
| Megafax F-833 (penetrant, a product of Dai-Nippon Ink and Chemicals, Inc.) | 0.1 | 0.2 |
| Magnesium chloride (melamine compound reaction catalyst) | 1 | 2 |
| Phosphoric acid (melamine compound reaction catalyst) | 0.1 | 0.2 |
| Water | 75.8 | 51.6 |
| | 100 | 100 |

The flame-proofness was determined in the same way as in Example 1 and the touch evaluated in the same manner as in Example 3. Results are as set out in Table 4, from which it is seen that at the antimony oxide content of 0.5% in polyester the fabrics do not exhibit the carbonization burning mechanism and are not flame-proof, while at its contents not lower than 1.5% the carbonization burning tendency becomes stronger as the content increases, and at 20% content the same burning mechanism as cellulose is recognized, proving a superior flame-proofness.

TABLE 4

| | $Sb_2O_3$ Content of Polyester Fiber (wt. %) | flame proofing Agent Bath | Pickup (wt. %) | Flame-proofness Carbonized Length (cm) | Flame-proofness After Flame Time (second) | Touch (mm) | P Content (wt. %) |
|---|---|---|---|---|---|---|---|
| Example | | | | | | | |
| 4-1 | 1.5 | A | 16.8 | 24.8 | 14 | 65 | 1.3 |
| 4-2 | " | B | 28.2 | 13.8 | 3 | 83 | 2.3 |
| 4-3 | 5 | A | 15.8 | 22.6 | 7 | 63 | 1.3 |
| 4-4 | " | B | | | | | |
| 4-5 | 10 | A | 14.9 | 16.5 | 2 | 61 | 1.2 |
| 4-6 | " | B | 26.6 | 10.4 | 0 | 78 | 2.1 |
| 4-7 | 20 | A | 15.1 | 13.1 | 0 | 64 | 1.2 |
| 4-8 | " | B | 27.7 | 10.2 | 0 | 78 | 2.2 |
| Comparative | | | | | | | |
| 4-1 | 0.5 | A | 14.6 | burnt down | — | 65 | 1.2 |
| 4-2 | " | B | 32.5 | burnt down | — | 84 | 2.6 |

EXAMPLE 5

A blended 50/50 fabric (plane woven fabric) comprising polyester fiber containing 10 wt.% of antimony trioxide and cotton yarn and having a weight of 250 g/m² was subjected to desizing and scouring by conventional methods. Then, using the following treating compositions, an amino resin coating was formed on the fiber surfaces or therebetween:

| | |
|---|---|
| Sumitex Resin M-3 (a product of Sumitomo Chemical Co., Ltd.) | 7.0% |
| Ammonium persulfate | 0.3 |
| Megafax F-833 (a product of Dai-Nippon Ink and Chemicals, Inc.) | 0.2 |
| Water | 92.5 |
| | 100.0 |

The fabric was padded with this resin composition at a pickup of 80% and then immediately subjected to steaming at 105° C., 100% RH for 3 minutes by means of a hanging type steamer, followed by water-washing and drying.

Flame-proofing was performed by two methods. In one method, the fabric was impregnated with a water-diluted dispersion (effective component 40%) of hexabromocyclododecane, then dried and thereafter treated with dry heat at 190° C. for 1 minute. In the other method, the fabric was impregnated with a water-diluted composition comprising 70 parts of Pyrovatex CP (a product of CIBA-GEIGY AG) consisting principally of N-methylophosphonopripion amide, 27 parts of trimethylolemlamine and 3 parts of potassium persulfate, and then subjected to heated steaming at 103° C. for 3 minutes. By way of comparison, there were produced fabrics through the flame-proofing step but without going through the amino resin treatment step, as well as fabrics using conventional polyester fiber and cotton yarn and having been subjected to the above flame-proofing treatment. Flame-proofness was evaluated in accordance with the method defined by the U.S. DOC FF-3-71 as in Example 1 and the method (one minute heating) defined by JIS L-1091 45° Micro Burner Flaming Test.

Results are as set out in Table 5, from which it is seen that the fiber blended product of the present invention containing amino resin are improved in the carbonization accelerating effect. This is apparent from the fact that the carbonized length evaluated according to the Vertical Flaming Test is very small.

TABLE 5

| | $Sb_2O_3$ Content of Polyester Fiber (wt. %) | Pickup of Amino Resin (wt. %) | Flame-proofing Agent* | | Flame-proofness | | | Br or P Content (wt. %) |
|---|---|---|---|---|---|---|---|---|
| | | | Name | Pickup (wt. %) | Vertical Flaming Test (Char Length, cm) | 45° Micro Burner Flaming test (Carbonized Area, $cm^2$) | Touch (mm) | |
| Example | | | | | | | | |
| 5-1 | 10 | 0 | A | 6.5 | 16.7 | 36 | 47 | 4.9 |
| 5-2 | " | " | " | 8.4 | 12.5 | 28 | 49 | 6.3 |
| 5-3 | " | " | " | 13.4 | 10.3 | 24 | 53 | 10.0 |
| 5-4 | " | " | " | 16.7 | 10.1 | 21 | 58 | 12.5 |
| Comparative Example | | | | | | | | |
| Example 5-1 | " | " | B | 4.8 | burnt down | burnt down | 64 | 8.4 |
| 5-5 | " | " | " | 11.3 | 21.0 | 120 | 73 | 0.9 |
| 5-6 | " | " | " | 18.7 | 15.8 | 56 | 76 | 1.5 |
| 5-7 | " | " | " | 24.5 | 11.2 | 29 | 83 | 2.0 |
| 5-2 | " | " | " | 31.0 | 10.3 | 23 | 95 | 2.5 |
| Example | | | | | | | | |
| 5-8 | " | 2.8 | A | 3.6 | 23.4 | 87 | 51 | 2.7 |
| 5-9 | " | " | " | 6.4 | 13.6 | 38 | 54 | 4.8 |
| 5-10 | " | " | " | 8.1 | 10.2 | 27 | 57 | 6.1 |
| 5-11 | " | " | " | 11.5 | 8.4 | 23 | 61 | 8.6 |
| 5-12 | " | " | " | 13.2 | 7.8 | 20 | 64 | 9.9 |
| 5-13 | " | " | B | 3.4 | burnt down | 185 | 61 | 0.3 |
| 5-14 | " | " | " | 6.1 | 19.1 | 72 | 67 | 0.5 |
| 5-15 | " | " | " | 9.2 | 13.0 | 26 | 71 | 0.7 |
| 5-16 | " | " | " | 13.6 | 10.8 | 23 | 76 | 1.1 |
| Comparative Example | | | | | | | | |
| 5-3 | " | " | " | 25.0 | 9.4 | 22 | 88 | 2.0 |
| 5-4 | 0.03 | 0 | A | 8.1 | burnt down | burnt down | 49 | 6.1 |
| 5-5 | " | " | " | 11.3 | " | " | 53 | 8.4 |
| 5-6 | " | " | " | 18.2 | " | " | 57 | 13.6 |
| 5-7 | " | 2.8 | B | 7.2 | " | " | 65 | 0.6 |
| 5-8 | " | " | " | 16.8 | " | " | 79 | 1.3 |
| 5-9 | " | " | " | 32.4 | 21.3 | " | 103 | 2.6 |

*Flame-proofing compounds:
A . . . hexabromocyclododecane
B . . . Pyrovatex CP

EXAMPLE 6

A blended 50/50 fabric (plane woven fabric) comprising polyester fiber containing 5 wt.% of antimony trioxide and cotton yarn and having a weight of 210 $g/m^2$ was impregnated with a water dispersion of HBCD, then dried at 120° C. for 3 minutes and thereafter heat-treated at 190° C. for 2 minutes by means of a dry heat tenter, followed by washing at 60° C. for 10 minutes by means of a domestic electric washing machine. The thus-treated fabric was then impregnated with a composition comprising 10 parts of Hoskon 76 (vinyl phosphonate, a product of Meisei Kagaku K.K.), 5 parts of N-methylolacrylamide, 0.5 part of ammonium persulfate and 83.5 parts of water, then subjected to steaming at 103° C. for 5 minutes, washed at 60° C. for 10 minutes and thereafter dried with dry heat at 150° C. for 5 minutes. Results are as set out in Table 6. As a result of analysis, it was confirmed that bromine was absorbed selectively by polyester, contributing to the synergistic effect with antimony, and that phosphorus was resinified around fibers centered on cotton, thus proving a high flame-proofing effect.

TABLE 6

| Example | HBCD (%) | Hoskon 76 (%) | DOC-FF-3-71 Carbonized Length (cm) |
|---|---|---|---|
| 6-1 | 4.8 | 8.2 | 18.8 |
| 6-2 | 10.5 | 8.1 | 11.2 |
| 6-3 | 13.1 | 8.1 | 10.4 |

What is claimed is:

1. A flame-proof fiber product comprising a blend consisting essentially of a cellulosic fiber and a polyester fiber selected from the group consisting of polyethylene terephthalate, polybutylene terephthalate and mixtures thereof, said polyester fiber containing at least 5% by weight of an antimony oxide and characterized by a carbonization burning mechanism, said surface of said flame-proof fiber product provided with at least one agent selected from the group consisting of a halogen-based flame-proofing agent selected from the group consisting of cycloalkanes containing 7 to 12 carbon atoms and 3 to 6 halogen atoms bonded to carbon; phenylglycidyl derivatives containing 1 to 6 halogen atoms bonded to the benzene ring; compounds having the structural formula

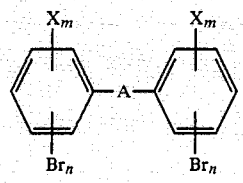

wherein X is —R, —OR, —OH or —O(CHR'CHR-"O)zH; where R is $C_1$–$C_3$ alkyl or halogenated alkyl; R' and R" are hydrogen or methyl with the proviso that R' and R" are not both methyl; z is an integer of 1 to 4; A is —O—, —NH—, —$CH_2$—, —$C(CH_3)_2$— or —$SO_2$—, alternatively, A is not present; m is 0 or an integer of 1 to 4; and n is an integer of 1 to 5; a compound having the structural formula

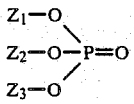

where $Z_1$, $Z_2$ and $Z_3$ are each a halogenated aliphatic or aromatic radical; and a phosphorus-based flame-proofing agent selected from the group consisting of vinyl group-containing flame-proofing phosphorus compounds and epoxy group-containing phosphorus compounds and mixtures thereof.

2. A flame-proof fiber product as set forth in claim 1, wherein the amount of said antimony oxide is in the range of 5 to 20 percent by weight.

3. A flame-proof fiber product as set forth in claim 1, wherein the amount of said antimony oxide is in the range of 10 to 15 percent by weight.

4. A flame-proof fiber product as set forth in claim 1, wherein the amount of said flame-proofing agent is in the range of ½ to 5 times the amount of said antimony oxide.

5. A flame-proof fiber product as set forth in claim 1, wherein the amount of said flame-proofing agent is in the range of 1 to 3 times the amount of said antimony oxide.

6. A flame-proof fiber product as set forth in claim 1, wherein the content of said flame-proofing agent is in the range of 5 to 30 percent by weight based on the weight of the fibers.

7. A flame-proof fiber product as set forth in claim 1, wherein the content of said flame-proofing agent is in the range of 10 to 20 percent by weight.

8. A flame-proof fiber product as set forth in claim 1, characterized by having an amino resin coating on the surfaces of the fibers.

9. A flame-proof fiber product as set forth in claim 8, wherein the amount of said amino resin is in the range of 0.5 percent by weight based on the weight of the fibers.

10. A flame-proof fiber product as set forth in claim 8, wherein the amount of said amino resin is in the range 1 to 10 percent by weight based on the weight of the fibers.

11. A flame-proof fiber product as set forth in claim 8, wherein the amount of said amino resin is in the range of 2 to 7 percent by weight based on the weight of the fibers.

12. A flame-proof fiber product comprising a blend consisting essentially of a cellulosic fiber and a polyester fiber selected from the group consisting of polyethylene terephthalate, polybutylene terephthalate and mixtures thereof, the polyester fiber being coated with an amino resin, and an antimony oxide and a halogen-based flame-proofing agent selected from the group consisting of cycloalkanes containing 7 to 12 carbon atoms and 3 to 6 halogen atoms bonded to carbon; phenylglycidyl derivatives containing 1 to 6 halogen atoms bonded to the benzene rings; compounds having the structural formula

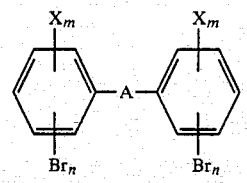

where X is —R, —OR, —OH or —O(CHR'CHR-"O)zH; where R is $C_1$–$C_3$ alkyl or halogenated alkyl; R' and R" are hydrogen or methyl with the proviso that R' and R" are both not methyl; z is an integer of 1 to 4; A is —O—, —NH—, —$CH_2$—, —$(CH_3)_2$— or —$SO_2$—, alternatively, A is not present; m is 0 or an integer of 1 to 4; and n is an integer of 1 to 5; and a phosphorus compound having the structural formula

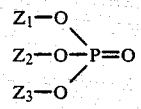

where $Z_1$, $Z_2$ and $Z_3$ are each a halogenated aliphatic or aromatic radical, said antimony oxide and halogenated-based flame-proofing agent being contained mainly in the polyester fiber and said phosphorus compound being contained mainly in the amino resin and in the cellulosic fiber.

13. A flame-proof fiber product as set forth in claim 12, wherein said amino resin contains a phosphorus-based flame-proofing agent selected from the group consisting of vinyl group-containing flame-proofing phosphorus compounds, epoxy group-containing flame-proofing phosphorus compounds and mixtures thereof bonded thereto.

14. A flame-proof fiber product as set forth in claim 12, wherein the halogen is bromine.

* * * * *

UNITED STATES PATENT AND TRADEMARK OFFICE

CERTIFICATE OF CORRECTION

PATENT NO. : 4,794,037

DATED : December 27, 1988

INVENTOR(S) : Yoshinori Hosoda, et al.

It is certified that error appears in the above-identified patent and that said Letters Patent is hereby corrected as shown below:

Column 4, line 27: "n in an" should read as --n is an--

Column 4, line 48: "z in an" should read as --z is an--

Column 6, line 50: "resin of the fiber" should read as --resin on the fiber--

Column 7, line 42: "compound my be" should read as --compound may be--

Column 11, second heading under Table 4: "flame proofing" should read as --Flame proofing--

Column 16, line 3, Claim 9: "0.5 percent" should read as --0.5 to 15 percent--

Signed and Sealed this

Twenty-third Day of January, 1990

*Attest:*

JEFFREY M. SAMUELS

*Attesting Officer* *Acting Commissioner of Patents and Trademarks*